United States Patent [19]

Elias

[11] 3,980,278

[45] Sept. 14, 1976

[54] INTERLOCKING SAFETY FENCE POST AND PANEL

[75] Inventor: Murray A. Elias, Islington, Canada

[73] Assignee: Dell Holdings Limited, Toronto, Canada

[22] Filed: Jan. 17, 1975

[21] Appl. No.: 541,872

[52] U.S. Cl. ..... 256/59

[51] Int. Cl.[2] ..... E04H 17/14

[58] Field of Search ..... 24/248, 263 SB; 256/59, 256/65, DIG. 6, 1, 68; 248/226 B, 226 C

[56] References Cited

UNITED STATES PATENTS

| | | | |
|---|---|---|---|
| 1,284,569 | 11/1918 | Bikowski | 256/24 |
| 2,343,350 | 3/1944 | Warren | 52/161 |
| 2,633,995 | 4/1953 | Edelheit | 24/263 SB |
| 3,632,089 | 1/1972 | Smith | 256/1 |
| 3,637,182 | 1/1972 | Bohlman | 248/226 B |
| 3,863,899 | 2/1975 | Werner | 256/24 |

*Primary Examiner*—Werner H. Schroeder
*Assistant Examiner*—Doris L. Troutman
*Attorney, Agent, or Firm*—Fetherstonhaugh & Co.

[57] ABSTRACT

A safety fence post for use with the safety fence panel wherein the operating means for moving the feet of the posts into engagement with the site at which the post is to be mounted is inoperative when the safety fence panel is mounted on the safety post.

6 Claims, 6 Drawing Figures

INTERLOCKING SAFETY FENCE POST AND PANEL

FIELD OF INVENTION

This invention relates to construction safety fences and the posts used for mounting the construction safety fences at the site. In particular, this invention relates to a combination safety fence panel and a safety fence post wherein the safety fence post cannot be released without first deconnecting the safety fence.

PRIOR ART

In the construction industry, construction fences are mounted at the job site by means of a series of fence posts, each of which are adjustable in order to be releasably mounted at the job site. There are two common types of construction fence posts, namely, the floor to floor jack post and the shorter floor clamping post. The floor to floor jack post extends between the floors of a building in a construction site and is extensible in order to engage an upper and lower floor. The shorter clamping type post has a clamping mechanism at the lower end thereof which extends over the edge of a floor. Numerous attempts have been made to provide a safety fence post which is tamperproof so that the clamping adjustment cannot be carried out by anyone other than authorized personnel. These attempts have included the provision of an adjustment mechanism which cannot be operated without the aid of a tool specifically designed for the purpose. The difficulty with this type of apparatus is that the adjustment tools are misplaced and are frequently unavailable at the area of the job site when adjustment is required. In addition, these special purpose tools are expensive to manufacture and to maintain in good working order.

SUMMARY

The present invention overcomes the difficulties of the prior art described above and provides an operating mechanism in a safety fence post which is interlocked with a safety fence which is suspended therefrom in a manner such that the operating mechanism cannot be operated when the safety fence is mounted thereon.

According to an embodiment of the present invention, there is provided a combination of a safety fence panel and a safety fence post wherein the safety fence post has feet movable with respect to each other to cooperatively engage with a post mounting site to mount the post in an operative position at the site, operating means for moving the feet with respect to each other, a fence bracket mounted on said operating means, said fence bracket being adapted to engage with said fence panel when said fence post supports said fence panel in an operative position and to lock said operating means against movement permitting adjustment of said feet.

PREFERRED EMBODIMENT

The invention will be more clearly understood after reference to the following detailed specification read in conjunction with the drawings wherein.

Figure 1:
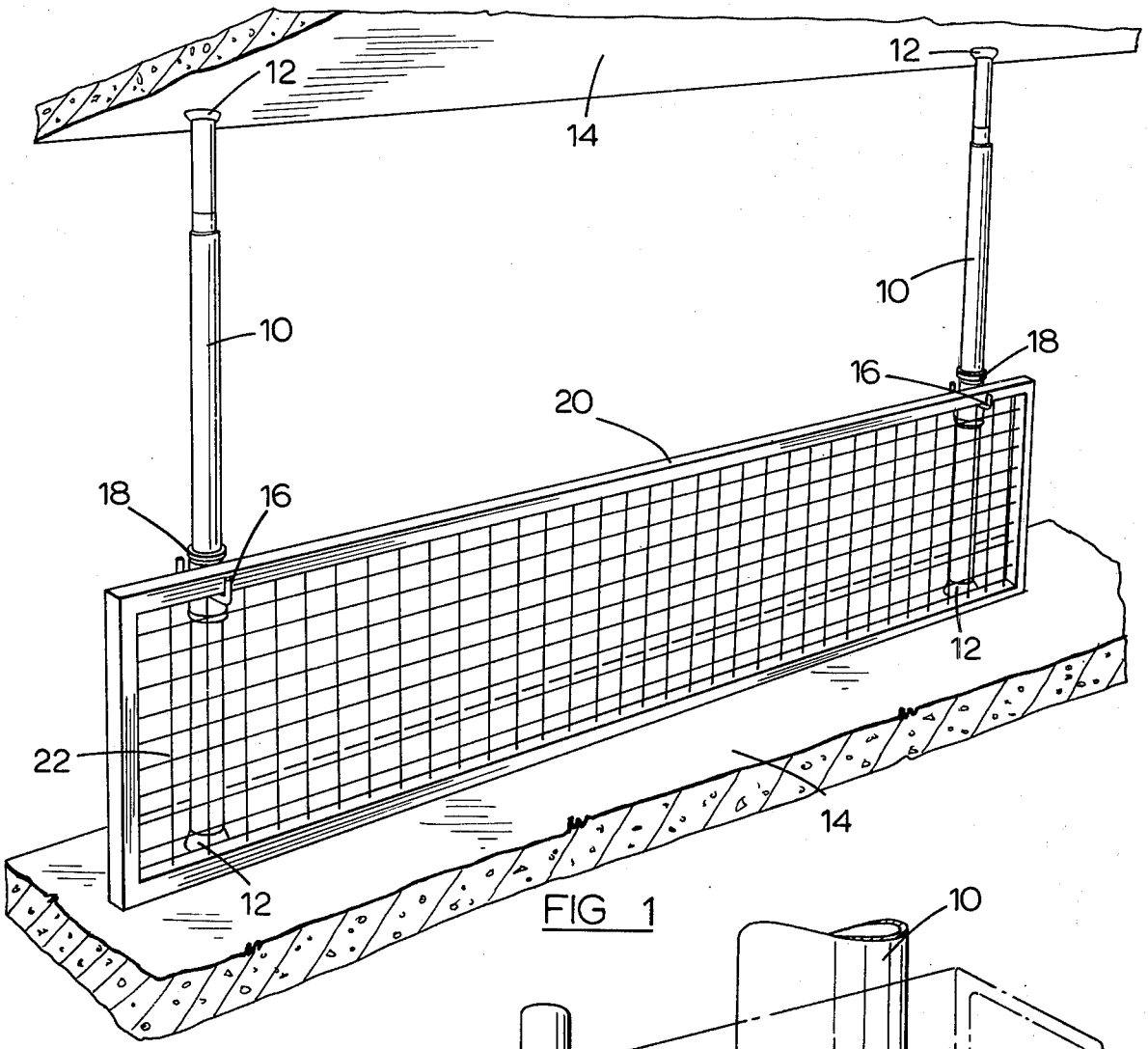
FIG. 1 is a pictorial view illustrating the manner in which a safety construction fence is mounted on safety fence posts according to an embodiment of the present invention.
Figure 2:
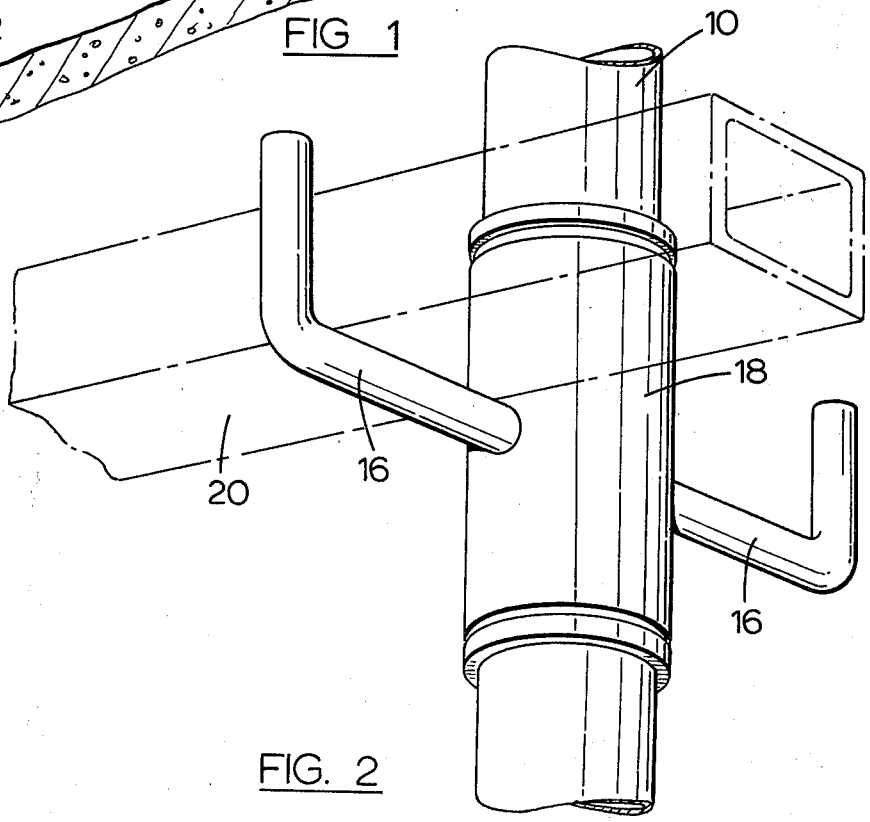
FIG. 2 is an enlarged detailed view illustrating the manner in which the operating means of the safety fence posts engages the safety fence panel.

In the embodiment of the invention illustrated in FIG. 1 of the drawings, the fence posts 10 are of the floor to floor type and have feet 12 at opposite ends thereof engaging floors 14 of a construction site. The feet 12 are movable towards and away from one another in response to rotation of turn-buckle 18. The turn-buckle 18 has diametrically oppositely opposed fence mounting brackets 16 extending outwardly therefrom. The upper rail 20 of a conventional safety fence panel 22 rests on the support bracket 16 and when the fence is in this position, it is impossible to move the support brackets 16 in a manner which would permit the adjustment of the length of the safety fences.

Figure 4:
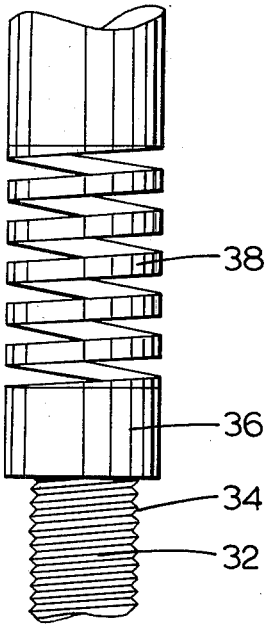
FIG. 4 is an enlarged detailed view of the jacking screw component of the fence post.
Figure 5:
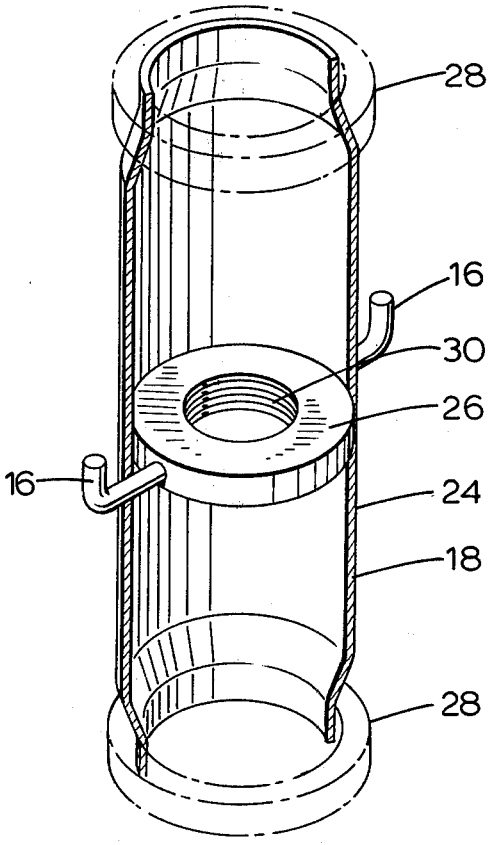
FIG. 5 is a partially sectioned pictorial view of the turn-buckle mechanism of the fence post.

As shown in FIG. 5 of the drawings, the turn-buckle member 18 consists of a tubular sleeve 24 having a nut 26 located substantially centrally of the length thereof. The nut 26 is secured within the sleeve 24 by welding or the like. The brackets 16 are also preferably secured to the nut 26. The opposite ends of the tubular sleeve 24 are of reduced diameter so as to extend in a close fitting relationship with respect to the telescoping tubular members which form the jacking post as will be described hereafter. The ends of the tubular member 24 are reinforced by rings 28. The nut 26 has a threaded passage 30 opening therethrough which is adapted to receive the threaded stem 32 of the jacking rod 34 (FIG. 4). The jacking rod 34 has an enlarged head portion 36 at the upper end thereof upon which there is secured a compression spring 38. The spring 38 is secured to the head by welding or the like.

Figure 3:
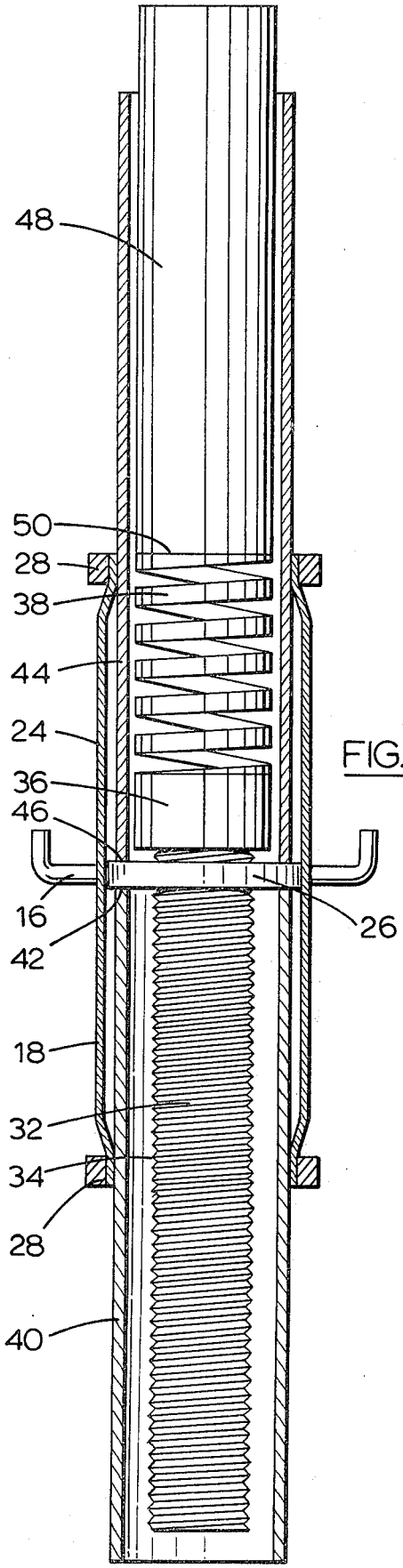
FIG. 3 is a longitudinal sectional view through a safety fence post according to an embodiment of the present invention.

To assemble the safety fence to the configuration shown in FIG. 3 of the drawings, the threaded stem 32 is mounted within the threaded passage 30 of the nut 26 of the turn-buckle 18. This assembly is then located in a position wherein the nut 26 rests on the upper end face 42 of a lower tubular member 40. A tubular sleeve 44 is located within the upper end of the turn-buckle 18 and has a lower end 46 resting on the upper surface of the nut 26. A third tubular member 48 has a lower end 50 resting on the upper end of the spring 38.

In use, the post 10 is vertically oriented between spaced floors and the turn-buckle 18 may be manually rotated by engaging the brackets 16. Rotating of the turn-buckle 18 causes rotation of the nut 26 which, in turn, drives the stem 32 and its associated head 36 upwardly with respect to the lower tubular member 40. The upper tubular member 48 is driven upwardly by the spring 38 into engagement with the upper floor. The turn-buckle 18 is rotated until the upper foot 12 engages the upper floor 14 to a sufficient extent to at least partially compress the compression spring 38. Then the brackets 16 are rotated to a position in which they may engage the top rail 20 of the fence 22. The top rail 20 of the fence 22 rests on a pair of brackets 16. When the top rail 20 is in this position, it is impossible to move the bracket 16 and, consequently, it is impossible to move the turn-buckle 18. This interlocking relationship between the brackets 16 and the fence 22 serves to prevent tampering with the assembly. The compression spring 38 is important in this type of apparatus as it accommodates variations in the floor height resulting from expansion and contraction in the structure due to changing climatic conditions.

Figure 6:
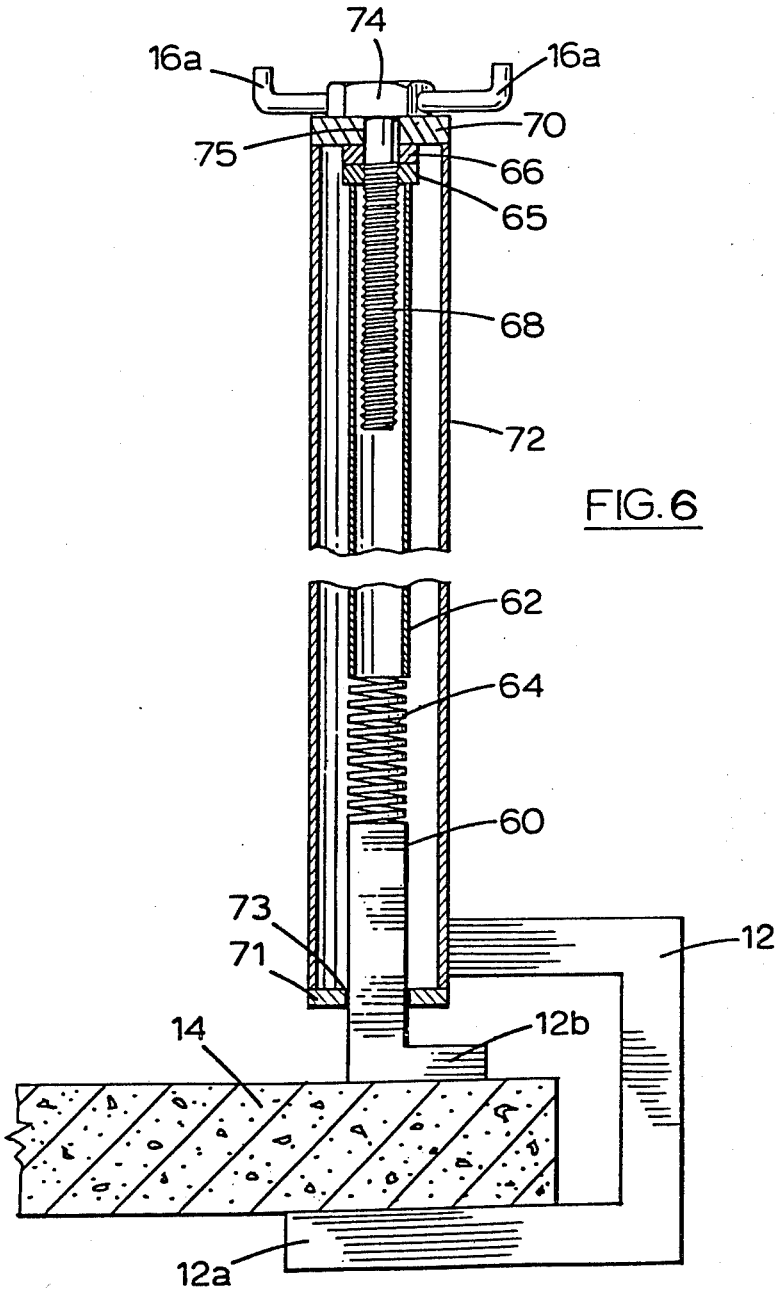
FIG. 6 is a partially sectioned view of a further embodiment of the invention.

As previously indicated, the present invention is applicable to the lower floor mounted posts such as that illustrated in FIG. 6 of the drawings. In this embodiment the post is of a type described in co-pending application Ser. No. 554,067 filed Feb. 28, 1975. In this type of post, the floor 14 is clamped between a stationary foot 12*a* and an adjustable foot 12*b*. The foot 12*b* is mounted at the lower end of a leg 60 which is connected to a tubular member 62 by means of a compression spring 64. The compression spring 64 is welded to the ends of the leg 60 and the tube 62. A nut 65 is mounted at the upper end of the tube 62 and threadably engages a threaded portion of a shaft 68. The shaft 68 passes through passage 75 in an end plate 70 at the upper end of the tube 72 and has a nut 74 secured at the upper end thereof. The shaft 68 is secured for rotation within the passage 75 by means of collar 66. Brackets 16*a* are mounted on the nut 74 and extend outwardly therefrom. Rotation of the nut 74 by manually engaging the brackets 16*a* causes rotation of the shaft 68. Rotation of the shaft 68 moves the nut 65 longitudinally with respect to the shaft. In order to effect clamping, the nut 65 is moved downwardly so that the foot 12*b* is driven into engagement with the floor 14. Continued winding of the nut 74 will cause compression of the spring 64 which is located between the leg 60 and the tubular member 62. The compression of the spring 64 serves to accommodate variations in thickness of the floor member 14 resulting from temperature variations and the like. A square shaped passage 73 in the end plate 71 prevents rotation of the leg 60.

Again, it will be noted that when the post of FIG. 6 is in use, a fence 22 may be mounted with the upper rail 20 thereof supported in the bracket 16*a* in such a way that the bracket 16*a* prevents rotation of the nut 74 when the fence is in an operative position.

From the foregoing, it will be apparent that it is not possible to adjust the clamping force applied by the safety fence posts when a safety fence is mounted thereon. In order to adjust the position of the turnbuckle 18 or the nut 74, it is necessary to remove the safety fence from the brackets 16 and 16*a*, respectively. When the fence is removed in this way, it is quite apparent to anyone in the vicinity that care must be taken until such time as the fence is replaced. The problem with many existing installations is that while the fence may be located in an opposite position and the fence posts may give the impression of safely securing the fence, the entire assembly may collapse very easily upon the application of a light load. Such a failure may occur at a time when a construction worker is relying upon the security of the safety fence so that the fence itself may constitute a greater hazard than would have been experienced by the worker if no fence had been present. An important feature of the present invention is the provision of the compression spring in the clamping mechanism. This compression spring ensures that an adequate clamping force will be applied by the post to its surroundings. This is an important feature in the device of the present invention wherein it is not possible to make adjustments to the clamping force when the safety fence is in an operative position. In other safety fence posts, adjustments may be made from time to time without removing the fence and, in fact, periodic adjustments are made in order to accommodate variations in the dimensions of the surrounding site at which the posts are mounted.

These and other advantages of the present invention will be apparent to those skilled in the art.

I claim:

1. In combination, a safety fence panel and a safety fence post, said safety fence post having feet which are movable with respect to each other to cooperatively engage with a post mounting site to mount the post in an operative position at the site, operating means for moving said feet with respect to each other, a fence bracket mounted on said operating means, said fence bracket being adapted to engage with said safety fence panel, when said post is in an operative position to support said safety fence, to lock said operating means whereby said operating means is rendered inoperative when a safety fence panel is supported on said safety post to prevent movement thereof permitting movement of said feet with respect to one another, said operating means including a rotatable member adapted to rotate about an axis that extends longitudinally of said post, said fence bracket connecting with said rotatable member, said safety post consisting of at least two elongated members which are telescopically mounted with respect to one another and wherein said operating means consists of a turn-buckle member disposed between said elongated members, said turn-buckle being rotatable to effect said movement, said fence bracket consisting of at least one bracket member secured to and projecting from said turn-buckle member.

2. In combination, a safety fence post and a safety fence panel, said safety fence post comprising:

a. a pair of elongated members having first and second ends and a longitudinal axis extending therebetween, the first ends of said elongated members being telescoped one within the other, the second ends forming mounting feet which are movable with respect to one another in response to telescoping of said elongated members to cooperate with one another to engage a post mounting site, b. rotary drive means drivingly interconnecting said elongated members, said rotary drive means being rotatable about said longitudinal axis to telescope said elongated members with respect to one another and thereby move said feet into and out of clamping engagement with a post mounting site, c. a fence bracket mounted on said rotary drive means and projecting radially outwardly from said longitudinal axis, said fence panel being releasably mounted on said fence bracket and locking said fence bracket to prevent rotation of said rotary drive means about said longitudinal axis whereby said rotary means is rendered inoperative when said safety fence panel is supported on said safety post to prevent movement thereof permitting movement of said feet with respect to one another.

3. In combination, a safety fence panel and a safety fence post, said safety fence post having feet which are movable with respect to each other to cooperatively engage with a post mounting site to mount the post in an operative position at the site, drive means mounted on said post, said drive means being movable with respect to said post to move said feet with respect to each other, a fence bracket secured to said drive means and projecting outwardly therefrom, said safety fence panel being mounted on said fence bracket and locking said fence bracket against movement with respect to said safety fence post whereby said drive means is locked against movement and is thereby rendered inoperative when a safety fence panel is supported on said safety fence post to prevent movement thereof permitting movement of said feet with respect to one another.

4. A combination as claimed in claim 1, wherein said fence bracket consists of two bracket members disposed diametrically opposite one another.

5. A combination as claimed in claim 4, wherein said feet are located at one end of said post and said operating means includes a rotatable member at the other end of said post adapted to rotate about an axis that extends longitudinally of said post, said fence bracket connecting with said rotatable member.

6. A combination as claimed in claim 1, wherein said operating means for moving said feet with respect to one another includes spring means spring loading at least one of said feet to urge it in a direction towards the other foot.

* * * * *